US008823596B2

(12) United States Patent
Chen et al.

(10) Patent No.: US 8,823,596 B2
(45) Date of Patent: Sep. 2, 2014

(54) MONOPOLE SLOT ANTENNA FOR MULTIPLE INPUT AND MULTIPLE OUTPUT

(71) Applicant: Southern Taiwan University of Science and Technology, Tainan (TW)

(72) Inventors: Wen-Shan Chen, Tainan (TW); Chi-Huang Lin, Tainan (TW)

(73) Assignee: Southern Taiwan University of Science and Technology, Tainan (TW)

( * ) Notice: Subject to any disclaimer, the term of this patent is extended or adjusted under 35 U.S.C. 154(b) by 176 days.

(21) Appl. No.: 13/650,014

(22) Filed: Oct. 11, 2012

(65) Prior Publication Data

US 2013/0088400 A1 Apr. 11, 2013

(30) Foreign Application Priority Data

Oct. 11, 2011 (TW) ..... 10136749 A

(51) Int. Cl.

| | |
|---|---|
| ***H01Q 13/10*** | (2006.01) |
| ***H01Q 1/52*** | (2006.01) |
| ***H01Q 1/24*** | (2006.01) |
| ***H01Q 21/28*** | (2006.01) |
| ***H01Q 13/16*** | (2006.01) |

(52) U.S. Cl.

CPC ..... *H01Q 13/10* (2013.01); *H01Q 1/521* (2013.01); *H01Q 1/243* (2013.01); *H01Q 21/28* (2013.01); *H01Q 13/16* (2013.01)

USPC ..... 343/770; 343/893; 343/702

(58) Field of Classification Search

USPC ..... 343/770, 893, 702

See application file for complete search history.

(56) References Cited

U.S. PATENT DOCUMENTS

| | | | | |
|---|---|---|---|---|
| 2007/0001911 | A1* | 1/2007 | Fujio et al. | 343/700 MS |
| 2010/0225553 | A1* | 9/2010 | Minard et al. | 343/770 |
| 2010/0238079 | A1* | 9/2010 | Ayatollahi et al. | 343/729 |

* cited by examiner

*Primary Examiner* — Dieu H Duong

(74) *Attorney, Agent, or Firm* — Muncy, Geissler, Olds & Lowe, P.C.

(57) ABSTRACT

The present invention pertains to a monopole slot antenna for multiple input and multiple output comprising a substrate. An antenna module is disposed on the first surface of the substrate and includes a first antenna and a second antenna disposed symmetrically with each other. A first inner monopole slot and a first outer monopole slot are disposed on the first antenna. The first inner monopole slot is formed by connecting a first straight section with a plurality of first bended sections. The first outer monopole slot surrounds the outer periphery of the first inner monopole slot. The second antenna is disposed symmetrical to the first antenna. An isolation unit is defined between the first antenna and the second antenna and has a third straight section and a third bended section. Furthermore, two feeding units are defined on the second surface of the substrate.

7 Claims, 8 Drawing Sheets

MONOPOLE SLOT ANTENNA FOR MULTIPLE INPUT AND MULTIPLE OUTPUT

FIELD OF THE INVENTION

The present invention relates to a monopole slot antenna for multiple input and multiple output, in particular to a antenna for multiple input and multiple output capable of reducing the volumevolume and maintaining a good antennal isolation degree for installing on the cell phone, PDA, notebook, tablet PC or 3G cell phone.

BACKGROUND OF THE INVENTION

Wireless communications, like cell phone, PDA, notebook, tablet PC, 3G cell phone and the like, have been an indispensable technology of life in the past few years. To achieve the requirement of wireless communication, the communication frequency band has to be multi-band and broadband. By the development of technology, the antenna is required to be small sized, simply structured and easily produced. Most ways for increasing the communication frequency band and the band width are to increase the amount of antenna or cover the operation frequency band by broadband antenna. The volume of the conventional antenna occupies a lot of circuit area, which is undoubtedly not adequate to the light wireless communication products nowadays. The conventional antenna for multiple input and multiple output mostly adopts to increase the distance between two antennas or dispose the antennas with different poles for enhancing the antenna isolation. Furthermore, there are ways of putting an isolation unit between the two antennas, like inserting the slot or monopole slot as a band reject filter between the two antennas or placing a band reject filter circuit between the feed ports of two antennas. Increasing the distance between the antennas cannot reduce the size of the antenna for multiple input and multiple output. Disposing antennas with different poles cannot get a symmetric diverse radiation pattern for serving as an omnidirectional radiation pattern capable of improving the dead spot problem. Inserting the band reject unit usually cannot maintain a good isolation degree when two antennas are very close, and the size cannot either reduce effectively. Placing the circuit causes a great increase on the fabrication cost and the fabrication difficulty. Generally, antennal isolation degree is explained as the receiving capability of the adjacent antennas when a power is sent from the antenna. In WLAN IEEE802.11n system, the adjacent antennas can transmit and receive at the same time. If the receiving capabilities of the adjacent antennas are high, the isolation degrees of the adjacent antennas are low. Namely, the signal actually has not been transmitted, but the system receives the signal instead. Consequently, the transmission is greatly reduced. On the other hand, if the receiving capabilities of the adjacent antennas are low, the isolation degrees of the adjacent antennas are high. Namely, the signal is completely transmitted by the two antennas, so that the transmission rate is greatly enhanced.

Referring to the Taiwan patent number 1317188 issued at Nov. 11, 2011, titled "antenna and antenna combination", it discloses an antenna disposed on a circuit board. The circuit board includes a first surface and a second surface. The antenna includes a feeding portion, a radiating portion, a first auxiliary radiating body, and a second auxiliary radiating body. The feeding portion includes a first feeding section and a second feeding section which are respectively disposed on the first surface and the second surface. The radiating portion includes a first radiating body, a second radiating body, a third radiating body, and a fourth radiating body. The first radiating body and the second radiating body are disposed on the first surface and electrically connected with the first feeding section; the third radiating body and the fourth radiating body are disposed on the second surface and electrically connected with the second feeding section. The first auxiliary radiating body is disposed on the first surface and electrically connected with the first radiating body; the second auxiliary radiating body is disposed on the first surface and electrically connected with the second radiating body. Therefore, Taiwan patent number 1317188 provides an antenna combination with the effects of less area/dimension and better isolation degree.

However, the isolation degree of the conventional patent is not good enough such that has the problems of serious signal interference and bad signal quality.

SUMMARY OF THE INVENTION

In consideration of the forgoing disadvantages of the conventional antenna for multiple input and multiple output, the present invention provides a monopole slot antenna for multiple input and multiple output comprising:

A substrate including a first surface and a second surface corresponding to each other;

An antenna module disposed on the first surface of the substrate. The antenna module includes a first antenna and a second antenna disposed separately and symmetrically with each other. The first antenna includes a first inner monopole slot and a first outer monopole slot. The first inner monopole slot is formed by connecting a first straight section with a plurality of first bended sections; the first outer monopole slot is defined as a linear slot for surrounding an outer periphery of the first inner monopole slot. The second antenna includes a second inner monopole slot and a second outer monopole slot. The second inner monopole slot is formed by connecting a second straight section with a plurality of second bended sections; the second outer monopole slot is defined as a linear slot for surrounding an outer periphery of the second inner monopole slot;

An isolation unit disposed on the first surface of the substrate. The isolation is located between the first antenna and the second antenna. The isolation unit includes a third straight section which is connected to a third bended section; and Two feeding units respectively disposed on the second surface of the substrate; the two feeding unit is respectively disposed corresponding to the first antenna and the second antenna.

Preferably, the first straight section is extended from a side of the substrate and connected to four first bended sections correspondingly bended as a continuous U-shaped contour; the first outer monopole slot is defined L-shaped. The second straight section is extended from the other side of the substrate and connected to four second bended sections correspondingly bended as a continuous U-shaped contour; the second outer monopole slot is defined L-shaped.

Preferably, the feeding unit is defined as a micro-strip.

Preferably, the third bended section is defined I-shaped.

Preferably, a length of the substrate is 50 mm and a width of the substrate is 20 mm.

Preferably, a length of the antenna module is 10.5 mm and a width of the antenna module is 20 mm.

In one aspect of the present invention, the present invention is capable of greatly reducing the volume, decreasing the cost, restraining the interference of metal, and maintaining a good isolation degree of the antenna for multiple input and multiple output.

In another aspect of the present invention, the present invention uses the lithographic design, thereby reducing the difficulty of fabricating process, and the plane antenna is easy to integrate with the system grounding surface. Alternatively, the present invention uses the materials like flexible print circuit to fabricate so as to apply in different sizes of mini wireless communication devices.

In further another aspect of the present invention, the antenna area of the present invention is only 10.5×20 $mm^2$. By the principle of electromagnetic screening, the distance between two antennas can be very close so as to be conducive to the miniaturized fabrication of the antenna and greatly reduce the occupied space.

DETAILED DESCRIPTION OF THE PREFERRED EMBODIMENT

Figure 1:
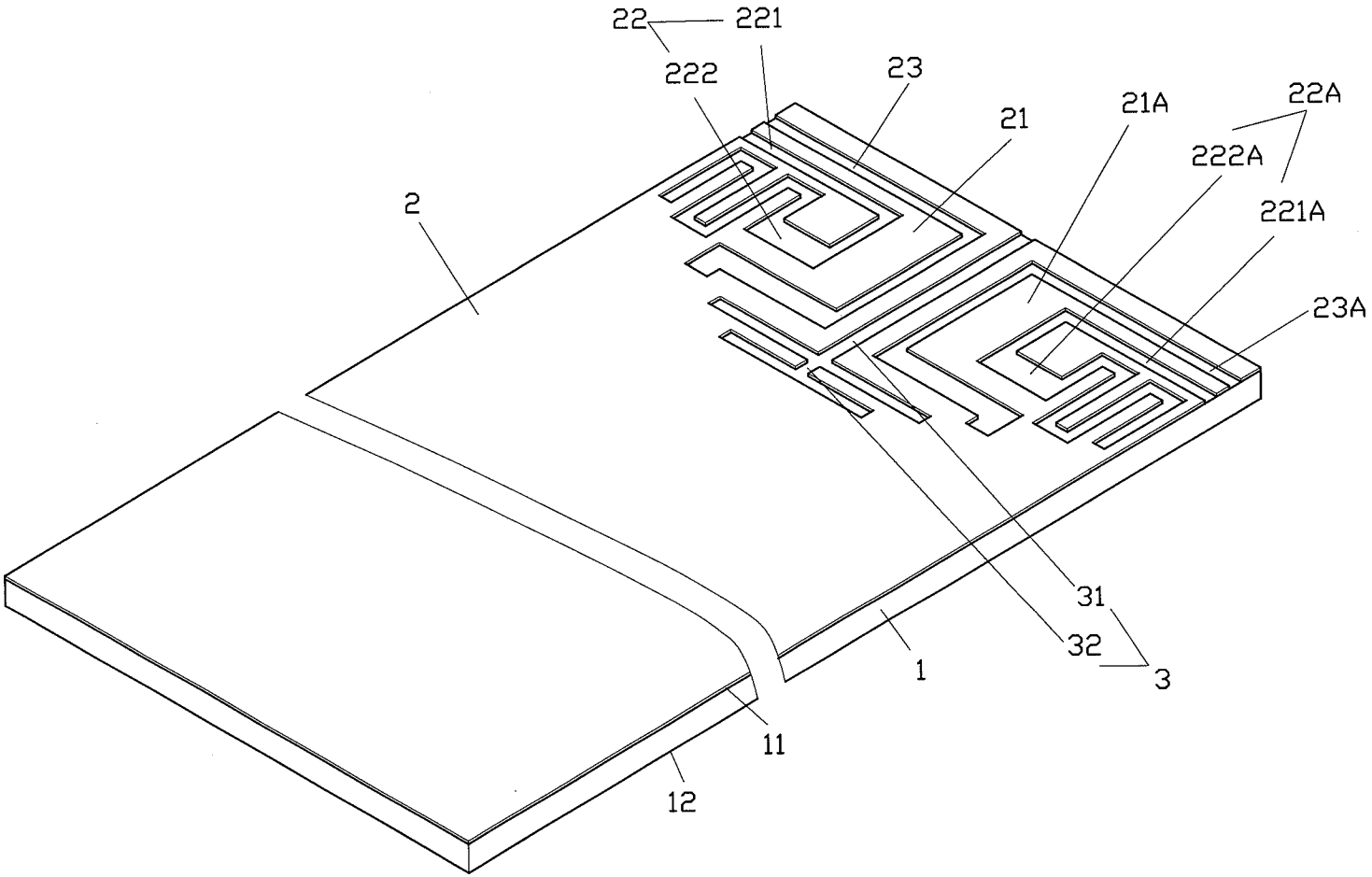
FIG. 1 is a perspective view showing a first preferred embodiment of the present invention.
Figure 2:
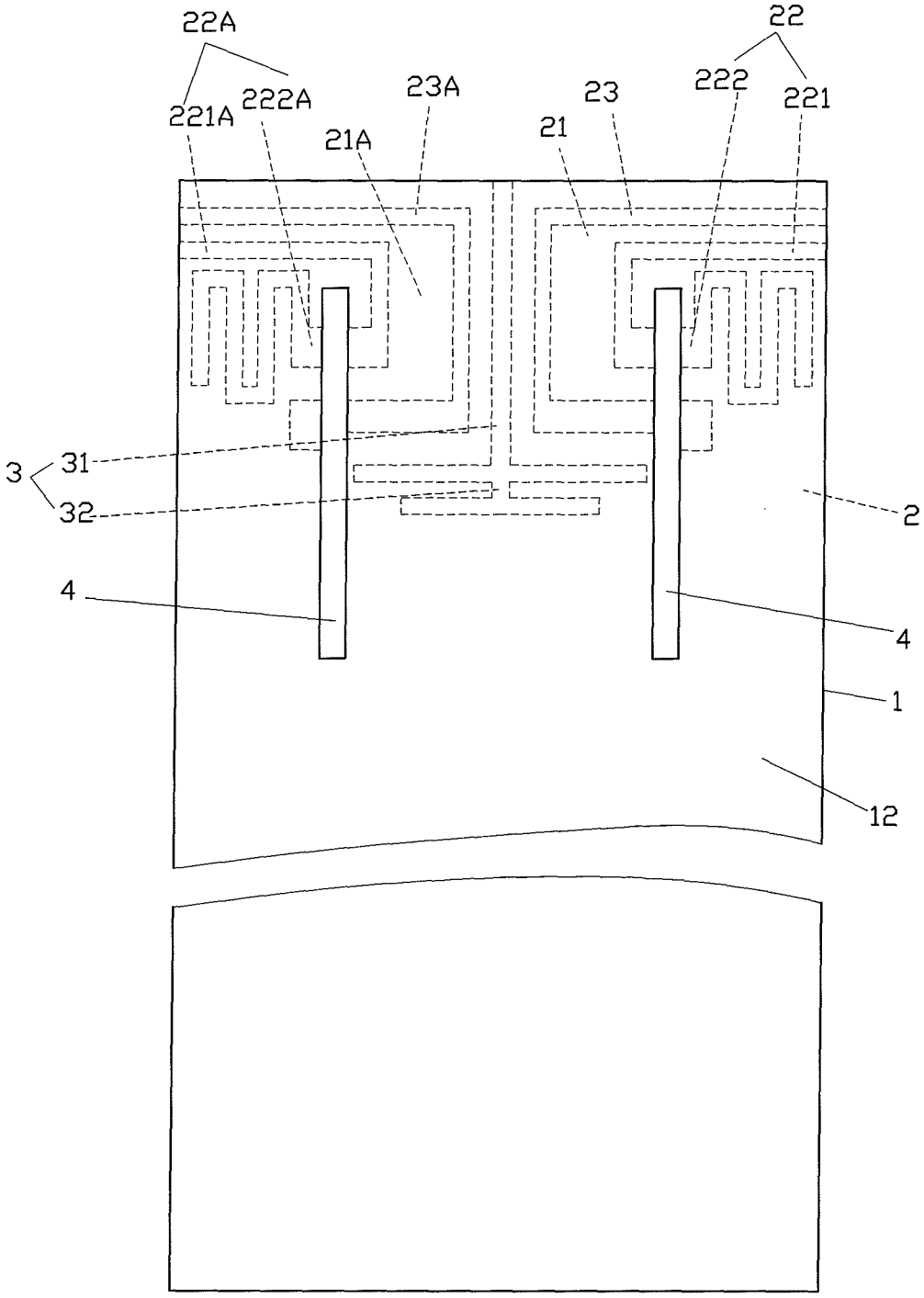
FIG. 2 is a schematic view showing a feeding unit on the second surface of the first preferred embodiment of the present invention.

Referring to FIGS. 1 and 2 showing a first preferred embodiment of the present invention, the monopole slot antenna for multiple input and multiple output comprises a substrate 1, an antenna module 2, an isolation unit 3, and a feeding unit 4, wherein, The substrate 1 is made of a FR4 fiberglass with the thickness of 0.4 mm, relative permittivity of 4.4, and the loss tangent of 0.0245. The substrate 1 with a length of 50 mm and a width of 20 mm includes a first surface 11 and a second surface 12.

The antenna module 2 is disposed on the first surface 11 of the substrate 1. The antenna module 2 with a length of 10.5 mm and a width of 20 mm includes a first antenna 21 and a second antenna 21A disposed separately and symmetrically with each other; wherein, a first inner monopole slot 22 and an outer monopole slot 23 are disposed on the first antenna 21. The first inner monopole slot 22 extends a first straight section 221 from a side of the substrate 1, and the first straight section 221 connects to four first bended sections 222 correspondingly bended as four continuous U-shaped contours. The first outer monopole slot 23 is generally defined as an L-shaped linear slot for surrounding the outer periphery of the first inner monopole slot 22. A second inner monopole slot 22A and an outer monopole slot 23A are similarly disposed on the second antenna 21A. The second inner monopole slot 22A extends a second straight section 221A from the other side of the substrate 1, and the second straight section 221A connects to four second bended sections 222A correspondingly bended as four continuous U-shaped contours. The second outer monopole slot 23A is defined as an L-shaped linear slot for surrounding the outer periphery of the second inner monopole slot 22A.

An isolation unit 3 is disposed on the first surface 11 of the substrate 1 and located on the middle line between the first antenna 21 and the second antenna 21A. The isolation unit 3 includes a third straight section 31. The third straight section 31 is connected to an I-shaped third bended section 32; and Two feeding units 4 are respectively disposed on the second surface 12 of the substrate 1. The feeding unit 4 is defined as a micro-strip, and the impedance of the micro-strip is 50 Ω.

Referring to FIGS. 1 and 2, In accordance with the principle of electromagnetic screened effect, when the first inner monopole slot 22 and the second inner monopole slot 22A of the antenna module 2 are activated, the power cannot be coupled because of the first inner monopole slot 22 and the second inner monopole slot 22A are respectively surrounded by the first outer monopole slot 23 and the second outer monopole slot 23A. Therefore, the isolation degree is enhanced. When the first outer monopole slot 23 and the second outer monopole slot 23A are activated, the isolation unit 3 therebetween blocks the amount of mutual coupling of the first outer monopole slot 23 and the second outer monopole slot 23A so as to enhance the isolation degree. Even though the first antenna 21 and the second antenna 21A are placed very close, the antennas can still have a good isolation degree under the foregoing proposed antenna of the present invention.

Figure 3:
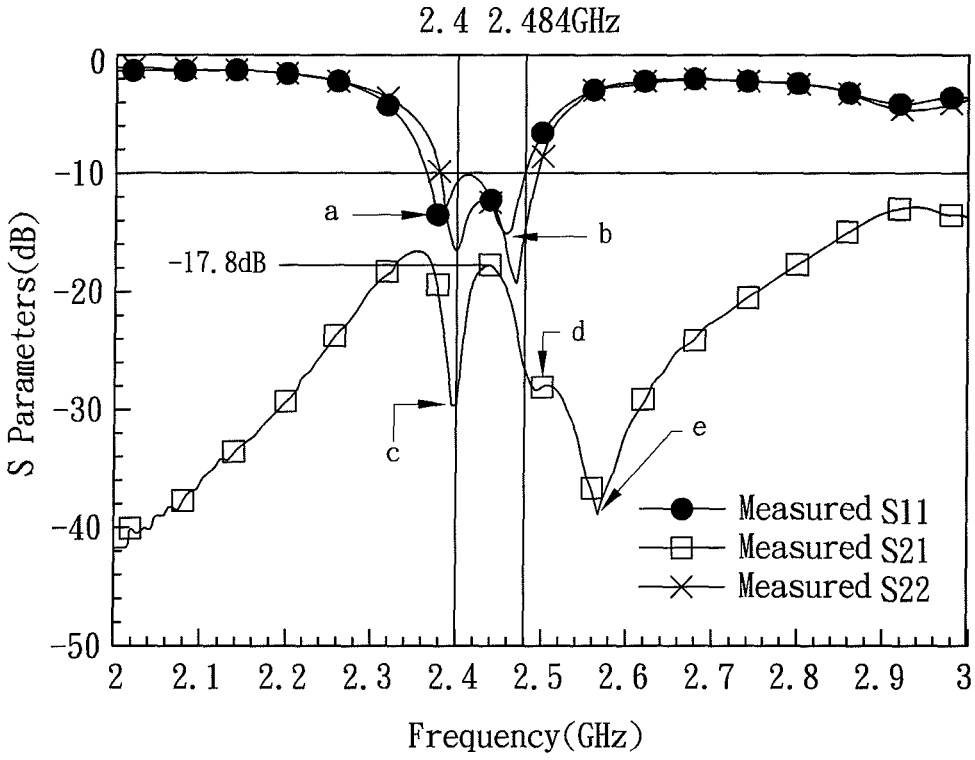
FIG. 3 is a diagram showing an S-parameter measurement of the first preferred embodiment of the present invention.
Figure 4:
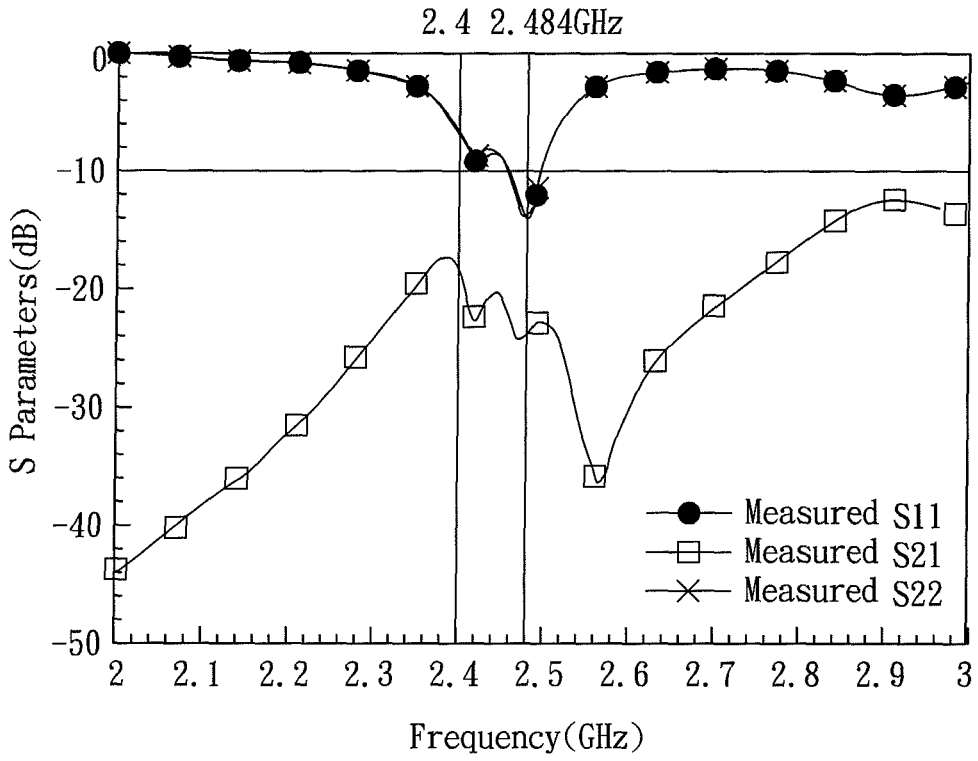
FIG. 4 is a diagram showing an S-parameter simulation of the first preferred embodiment of the present invention.

The S-parameter of the present invention results in measurement (as shown in FIG. 3) and simulation (as shown in FIG. 4). Referring to FIG. 3, the result of the measurement of the present invention conforms to the band width requirement of 2.4 GHz frequency band of WLAN. The results in the measurement and the simulation are quite similar.

Figure 5:
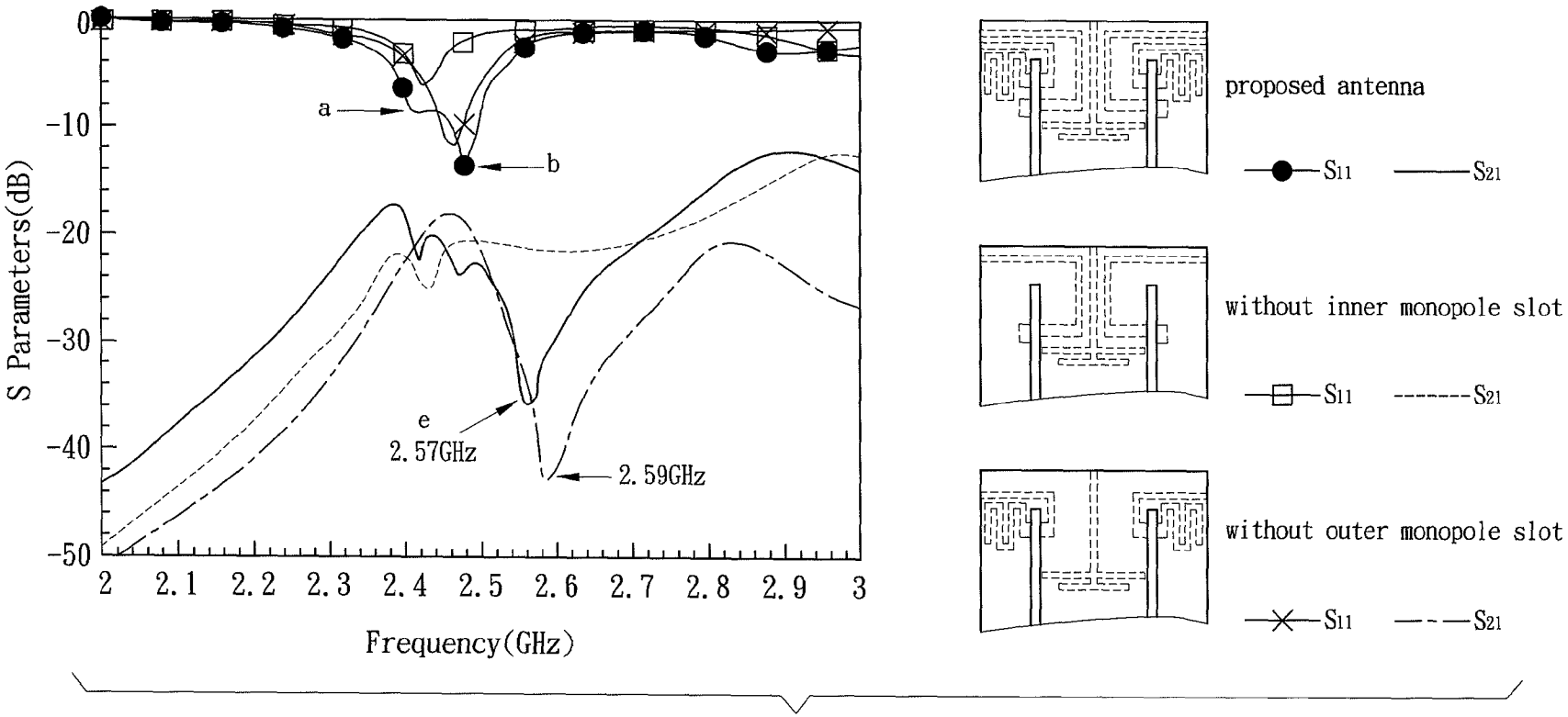
FIG. 5 is a diagram showing an S-parameter simulation of the proposed antenna, the proposed antenna without inner monopole slot and the proposed antenna without the outer monopole slot of the first preferred embodiment of the present invention.

The present invention is specialized in comparing the S-parameter simulation with and without the inner or the outer monopole slot. Referring to FIGS. 3 and 5, regarding the return lost (S11), the antenna in the first modality (a) is resulted from the outer monopole slot; the second modality (b) is provided by the inner monopole slot. The example without inner monopole slot shows that when the outer monopole slot is activated, the existence of the isolation unit in the middle allows the generation of a first isolated modality (c) defining the isolation degree under the same frequency of the first modality (a) of the return lost. Referring to FIG. 5, the example without outer monopole slot, without the outer monopole slot that blocks the coupling of the inner monopole slots at the two sides, the isolation degree has no modality under the same frequency of the second modality (b) of the return lost, so that the isolation degree is bad. But in this example, the isolation unit defined in the middle is deemed as an LC band reject filter for the inner monopole slot and resonates a 2.59 GHz modality. Therefore, the antenna design of the present invention results in a third isolated modality (e) having the 2.57 GHz isolation degree.

Figure 6:
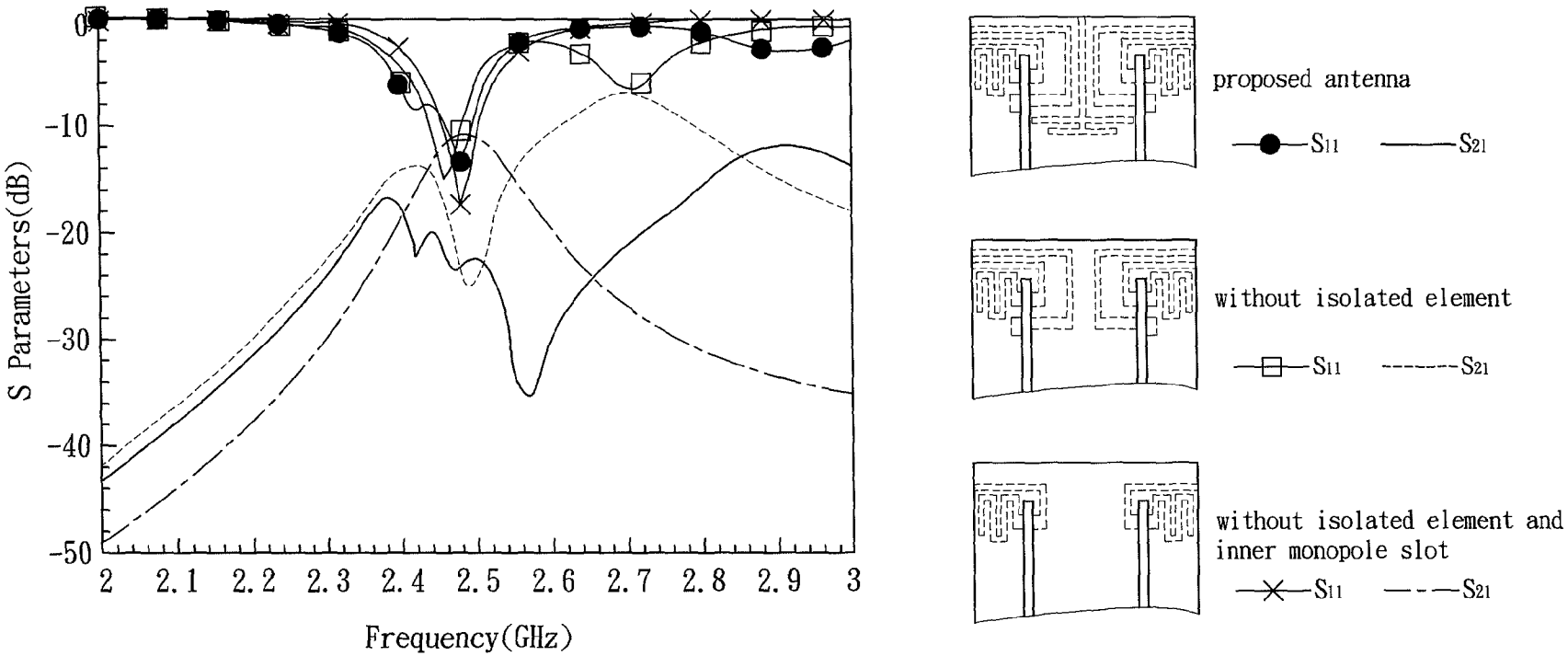
FIG. 6 is a diagram showing an S-parameter simulation of the proposed antenna, the proposed antenna without the isolation unit and the proposed antenna without both the outer monopole slot and the isolation unit of the first preferred embodiment of the present invention.

FIG. 6 shows the comparative view of S-parameter simulation of the uninserted isolation unit and the outer monopole slot. As long as the outer monopole slot exists, the second modality activated by the inner monopole slot is able to get a second isolated modality (d) of the corresponding isolation degree (as shown in FIG. 3) even under a condition without inserted isolation unit. Finally combining the inner monopole slot, the outer monopole slot, and the isolation unit and forming the antenna module of the present invention, two operation modalities can be formed in a band width which conforms to the requirement of WLAN IEEE802.11n. The antennal isolation degree (S21) can get two corresponding isolation degree modalities in the same resonant frequency so as to have good antennal isolation degree in the operation frequency band.

Figure 7:
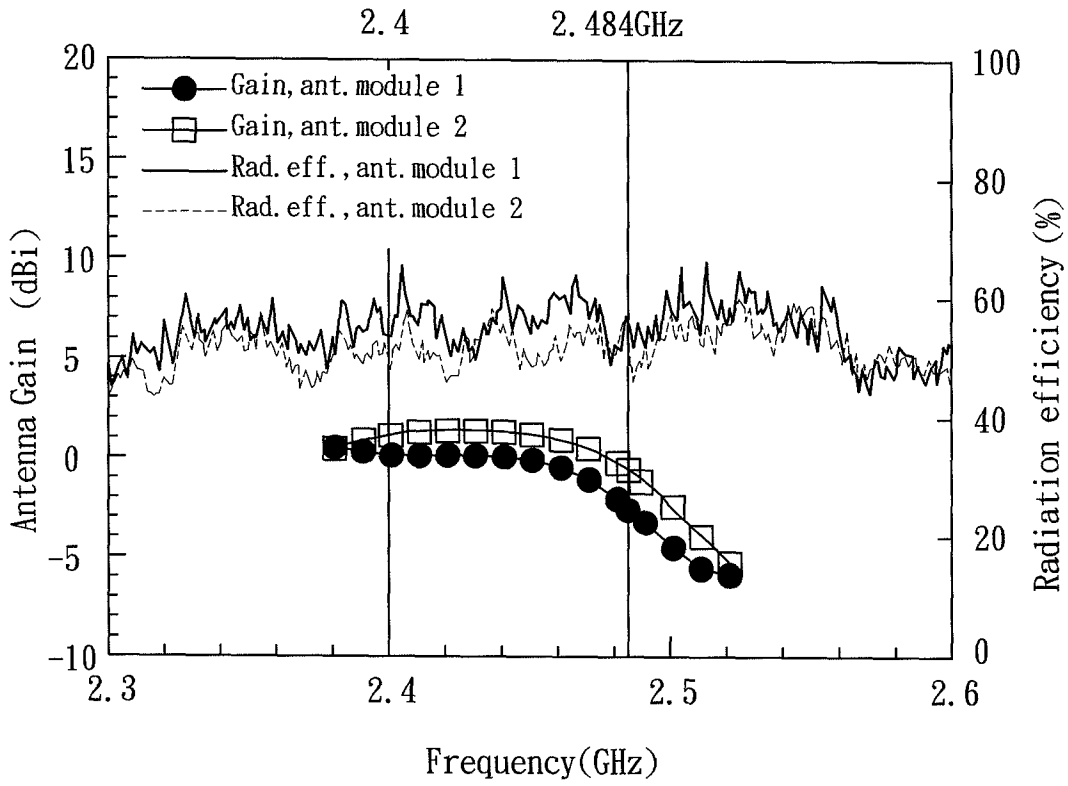
FIG. 7 is a diagram showing an antenna gain and radiation efficiency of the first preferred embodiment of the present invention in measurement.

Referring to FIG. 7 showing the antenna gain and radiation efficiency of the antenna of the present invention in measurement, the greatest antenna gain in the operation frequency band of the antenna is 1.23 dBi; the antenna gained variations of the two antenna modules are both less than 3 dB; the radiating efficiency in the measurement is approximately above 50%.

Figure 8:
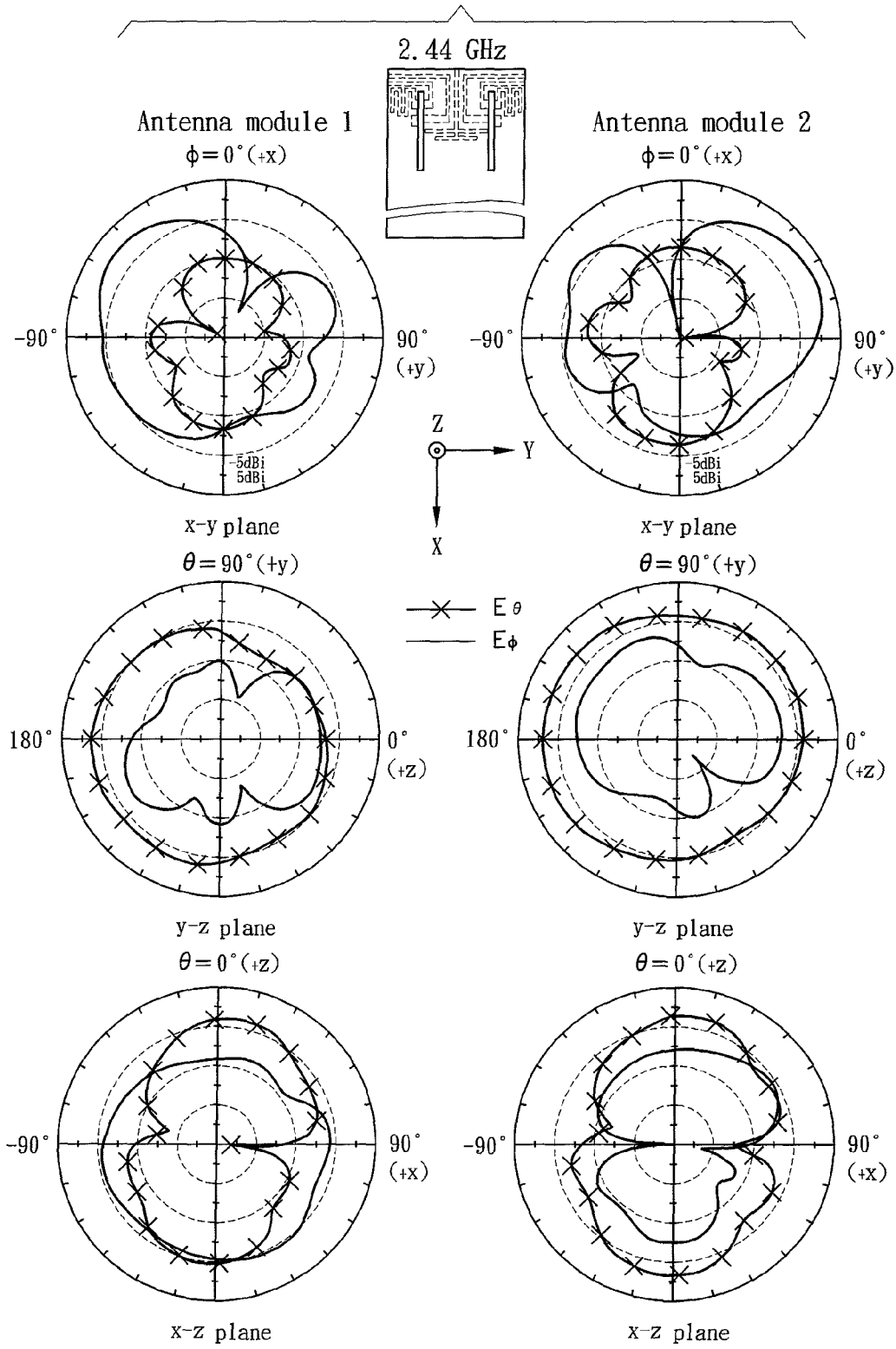
FIG. 8 is a set of diagrams showing a far-field radiation pattern of the first preferred embodiment of the present invention in measurement.

Referring to FIG. 8 showing a far-field radiation pattern of the antenna of the present invention in measurement, the first antenna and the second antenna of the antenna modules are symmetrically placed and resulted a symmetric diverse radiation pattern. The characteristic of the symmetric diverse radiation pattern, applied to the antenna for multiple input and multiple output technology, can diversify two apparent space-diverse pathes, so that the capacity of the frequency channel in transmission is enhanced. Furthermore, the antenna modules can also be deemed as an omnidirectional radiation pattern which can reduce the occurrence of the dead spot.

While we have shown and described the embodiment in accordance with the present invention, it should be clear to those skilled in the art that further embodiments may be made without departing from the scope of the present invention.

What is claimed is:

1. A monopole slot antenna for multiple input and multiple output comprising:

a substrate including a first surface and a second surface corresponding to each other;

an antenna module disposed on said first surface of said substrate; said antenna module including a first antenna and a second antenna disposed separately and symmetrically with each other; a first inner monopole slot and a first outer monopole slot being disposed on said first antenna; said first inner monopole slot being formed by connecting a first straight section with a plurality of first bended sections; said first outer monopole slot being defined as a linear slot for surrounding an outer periphery of said first inner monopole slot; a second inner monopole slot and a second outer monopole slot being disposed on said second antenna; said second inner monopole slot being formed by connecting a second straight section with a plurality of second bended sections; said second outer monopole slot being defined as a linear slot for surrounding an outer periphery of said second inner monopole slot;

an isolation unit disposed on said first surface of said substrate; said isolation unit being located between said first antenna and said second antenna; said isolation unit including a third straight section which is connected to a third bended section; and two feeding units respectively disposed on said second surface of said substrate; said two feeding unit being respectively disposed corresponding to said first antenna and said second antenna.

2. The monopole slot antenna for multiple input and multiple output as claimed in claim 1, wherein, said first straight section is extended from a side of said substrate and connected to four first bended sections correspondingly bended as a continuous U-shaped contour; said first outer monopole slot is defined L-shaped; said second straight section is extended from the other side of said substrate and connected to four second bended sections correspondingly bended as a continuous U-shaped contour; said second outer monopole slot is defined L-shaped.

3. The monopole slot antenna for multiple input and multiple output as claimed in claim 1, wherein, said feeding unit is defined as a micro-strip.

4. The monopole slot antenna for multiple input and multiple output as claimed in claim 1, wherein, said third bended section is defined I-shaped.

5. The monopole slot antenna for multiple input and multiple output as claimed in claim 1, wherein, a length of said substrate is 50 mm and a width of said substrate is 20 mm.

6. The monopole slot antenna for multiple input and multiple output as claimed in claim 1, wherein, a length of said antenna module is 10.5 mm and a width of said antenna module is 20 mm.

7. The monopole slot antenna for multiple input and multiple output as claimed in claim 5, wherein, a length of said antenna module is 10.5 mm and a width of said antenna module is 20 mm.

* * * * *